US008991628B2

(12) United States Patent
Wurster et al.

(10) Patent No.: US 8,991,628 B2
(45) Date of Patent: Mar. 31, 2015

(54) HOT-FILL JAR BASE

(75) Inventors: Michael P. Wurster, York, PA (US); Robert Waltemyer, Felton, PA (US); Justin A. Howell, New Cumberland, PA (US); Benton A. Lewis, Manchester, PA (US); Michael T. Kelly, Manchester, PA (US)

(73) Assignee: Graham Packaging Company, L.P., York, PA (US)

( * ) Notice: Subject to any disclaimer, the term of this patent is extended or adjusted under 35 U.S.C. 154(b) by 355 days.

(21) Appl. No.: 12/968,588

(22) Filed: Dec. 15, 2010

(65) Prior Publication Data

US 2012/0118899 A1 May 17, 2012

Related U.S. Application Data

(63) Continuation-in-part of application No. 29/379,000, filed on Nov. 12, 2010, now Pat. No. Des. 650,677.

(51) Int. Cl.
*B65D 1/42* (2006.01)
*B65D 1/02* (2006.01)

(52) U.S. Cl.
CPC ..... *B65D 1/0261* (2013.01); *B65D 2501/0018* (2013.01)
USPC ..... 215/373; 215/370; 220/600

(58) Field of Classification Search
CPC ..... B65D 1/0261
USPC ..... 215/370, 373; 220/600, 608, 609
See application file for complete search history.

(56) References Cited

U.S. PATENT DOCUMENTS

| | | | | |
|---|---|---|---|---|
| 2,157,896 | A * | 5/1939 | Held | 215/43 |
| 4,035,455 | A | 7/1977 | Rosencranz et al. | |
| 4,134,510 | A * | 1/1979 | Chang | 215/373 |
| 4,177,239 | A | 12/1979 | Gittner et al. | |
| 4,231,483 | A * | 11/1980 | Dechenne et al. | 220/608 |
| 4,318,882 | A | 3/1982 | Agrawal et al. | |
| 4,465,199 | A | 8/1984 | Aoki | |
| 4,585,158 | A | 4/1986 | Wardlaw, III | |
| 4,598,831 | A * | 7/1986 | Nakamura et al. | 215/373 |
| 3,062,262 | A | 2/1990 | Bit | |
| 5,713,480 | A * | 2/1998 | Petre et al. | 215/373 |
| D416,198 | S | 11/1999 | Lindsay et al. | |
| 5,989,661 | A | 11/1999 | Krishnakumar et al. | |
| 6,113,377 | A | 9/2000 | Clark | |
| 6,277,321 | B1 | 8/2001 | Vailliencourt et al. | |
| 6,595,380 | B2 | 7/2003 | Silvers | |
| 6,942,116 | B2 | 9/2005 | Lisch et al. | |
| 6,997,336 | B2 * | 2/2006 | Yourist et al. | 215/379 |
| 7,055,711 | B2 * | 6/2006 | Sasaki et al. | 215/373 |
| 7,150,372 | B2 | 12/2006 | Lisch et al. | |
| D547,660 | S | 7/2007 | Lepoitevin | |
| D548,083 | S | 8/2007 | Bourne | |
| D548,092 | S | 8/2007 | Klemm | |
| D551,559 | S | 9/2007 | Lepoitevin | |
| D560,506 | S | 1/2008 | Lepoitevin | |
| 7,350,657 | B2 * | 4/2008 | Eaton et al. | 215/384 |
| D570,217 | S | 6/2008 | Meillerais | |
| D583,245 | S | 12/2008 | Lepoitevin | |

(Continued)

*Primary Examiner* — Sue A Weaver
(74) *Attorney, Agent, or Firm* — Baker Botts L.L.P.

(57) ABSTRACT

A container base comprising recessed ribs. The curved recessed ribs permit lighter base weights than traditional bases. The base further permits a larger process window and improved product evacuation. Hot-fill performance of a container is also maintained and/or improved when using the base.

11 Claims, 8 Drawing Sheets

(56) References Cited

U.S. PATENT DOCUMENTS

| | | | | |
|---|---|---|---|---|
| D587,595 | S | 3/2009 | Schuemann | |
| 7,543,713 | B2 * | 6/2009 | Trude et al. | 215/373 |
| 7,861,876 | B2 * | 1/2011 | Stowitts | 215/381 |
| 2003/0052076 | A1 * | 3/2003 | Cheng et al. | 215/373 |
| 2006/0131257 | A1 * | 6/2006 | Gatewood et al. | 215/373 |
| 2007/0084821 | A1 | 4/2007 | Bysick et al. | |
| 2009/0159556 | A1 * | 6/2009 | Patcheak et al. | 215/373 |
| 2009/0218308 | A1 * | 9/2009 | Bunel et al. | 215/373 |
| 2009/0242575 | A1 * | 10/2009 | Kamineni et al. | 220/608 |
| 2009/0308835 | A1 * | 12/2009 | Boukobza | 215/370 |
| 2011/0204067 | A1 * | 8/2011 | Schneider et al. | 220/606 |

* cited by examiner

HOT-FILL JAR BASE

This application is a Continuation in Part of U.S. Design patent application Ser. No. 29/379,000, filed Nov. 12, 2010.

BACKGROUND OF THE INVENTION

1. Field of the Invention

The present invention is directed to the field of containers. In particular the field of the invention is directed to a minimum geometry container base.

2. Description of the Related Technology

Traditional plastic jar bases have been made similarly to the bases used in juice and isotonic drinks. These bases which perform well for hot-fill beverages at 185° F. are not good for enabling product evacuation in jar shaped containers. Jar shaped containers focus on improved product evacuation and typically use a conical base design. Such designs have a smaller process window, produce heavier containers and have issues with base sticking.

FIGS. 1(*a*)-1(*c*) show standard volcano type bases 3(*a*)-3(*c*) used with a jar-type container 4. A jar-type container 4 differs from a typical hot fill container by being filled at higher temperatures, typically 205° F. max. Jar-type containers also have larger finishes, currently up to 82 mm. Because of the larger finishes, a blow/trim process is primarily used to produce the larger finishes, therefore the finishes are thinner than injected finishes, and more susceptible to variation.

Therefore there is a need in the field to employ a jar base that is able to withstand the hot-filling process and provide good product evacuation. Additionally, creating a container that is lighter and has a larger process window is also desirable.

SUMMARY OF THE INVENTION

An object of the present invention is an improved container base.

Another object of the present invention is a jar base able to withstand the hot-filling process.

Still yet another object of the present invention is base that enables construction of a lighter container.

Another object of the present invention is a jar base that provides a larger process window.

An aspect of the present invention may be a base for a hot-fill container comprising: a peripheral lip located radially from a longitudinal axis of the base; an inner lip located radially from the longitudinal axis of the base, wherein the inner lip is located closer to the longitudinal axis than the peripheral lip; and an inverted rib extending from the inner lip towards the longitudinal axis, wherein a bottom rib portion of the inverted rib smoothly curves towards the longitudinal axis.

Another aspect of the present invention may be a hot-fill container comprising: a body; a finish; a base comprising; a standing surface; a concave planar surface extending towards a longitudinal axis; and an inverted rib located within the concave planar surface, wherein the inverted rib has a bottom rib portion that smoothly curves towards the longitudinal axis.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Hot-filling containers involves using plastic containers. Plastic containers are used due to their durability and lightweight nature. Polyethylene terephthalate (PET) is used to construct many of today's containers. PET containers are lightweight, inexpensive, recyclable and manufacturable in large quantities.

PET containers are used for products that traditionally were placed in glass bottles or jars. Often these products, such as juices and isotonics, were placed into the containers while the liquid product is at an elevated temperature, typically between 68° C.-96° C. (155° F.-205° F.) and usually about 85° C. (185° F.). When packaged in this manner, the hot temperature of the liquid is used to sterilize the container at the time of filling. This process is known as hot-filling. The containers that are designed to withstand the process are known as hot-fill containers.

A container that is used in the hot-fill process is subject to additional stresses on the container that can result in the container failing during storage or handling or to be deformed in some manner. The sidewalls of the container can become deformed and/or collapse as the container is being filled with hot fluids. The rigidity of the container can decrease after the hot-fill liquid is introduced into the container. The top-load of a container may also be affected.

After being hot-filled, the hot-filled containers are capped and allowed to reside at about the filling temperature for a predetermined amount of time. The containers and stored liquid may then be cooled so that the containers may be transferred to labeling, packaging and shipping operations. As the liquid stored in the container cools, thermal contraction occurs resulting in a reduction of volume. This results in the volume of liquid stored in the container being reduced. The reduction of liquid within the sealed container results in the creation of a negative pressure or vacuum within the container. If not controlled or otherwise accommodated for, these negative pressures result in deformation of the container which leads to either an aesthetically unacceptable container or one which is unstable. The container must be able to withstand such changes in pressure without failure.

Hot-fillable jar-type containers should be able to provide good product evacuation as well as being capable of withstanding the rigors of the hot-filling process. Now referring to the FIGS. 2-7, an exemplary base made in accordance with an embodiment of the present invention is shown.

Figure 1C:
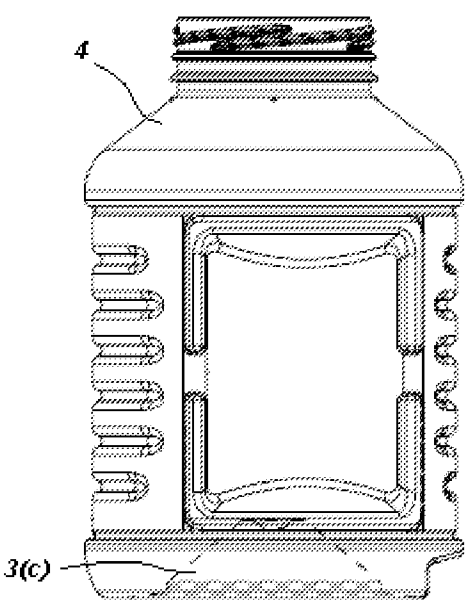
FIG. 1(c) PRIOR ART
FIGS. 1(*a*)-1(*c*) shows containers with volcano type bases.
Figure 1B:
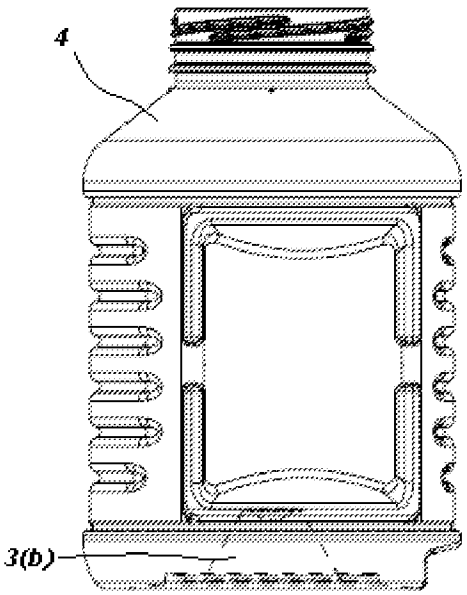
FIG. 1(b) PRIOR ART
Figure 1A:
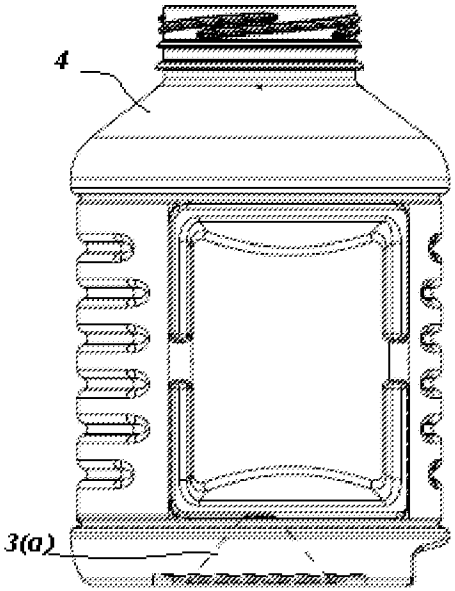
FIG. 1(a) PRIOR ART
Figure 2:
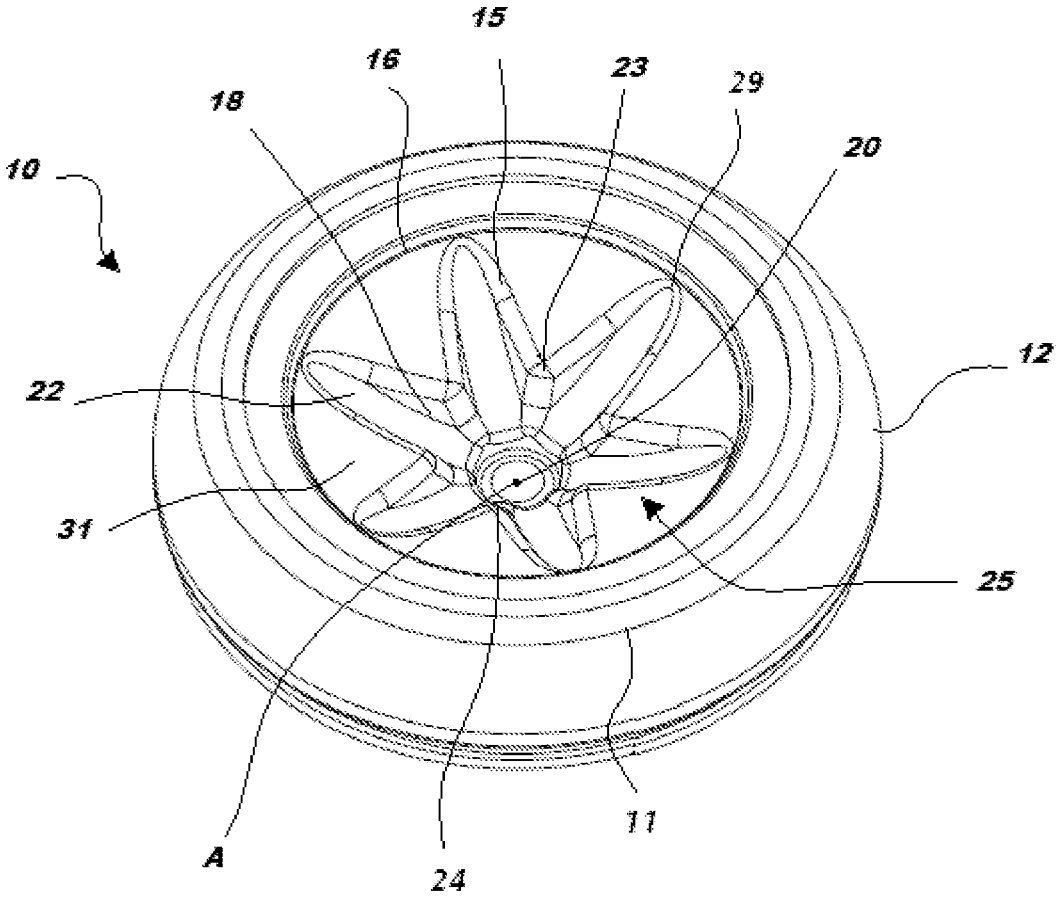
FIG. 2 is a bottom up perspective view of a container base made in accordance with an embodiment of the present invention.

FIG. 2 shows a bottom up perspective view of a container base 10 made in accordance with an embodiment of the present invention. The base 10 shown in FIG. 2 has six inverted ribs 25 located symetrically and radially about the longitudinal axis A. The longitudinal axis A passes through the center 20 of the base 10 as well as the container for which the base 10 is part. The position of the inverted ribs 25 forms an asterisk shape. While there are six inverted ribs 25 shown in the figures it should be understood that more or less ribs may be used in the formation of the base provided that sufficient structure was still present in order to maintain stability after the hot-fill process and further enable sufficient product evacuation.

The base 10 has an outer surface 12 which is located radially from the longitudinal axis A. At a distal end of the outer surface 12 is the standing surface 9 which merges with the a peripheral lip 11. The standing surface 9 is that part of the container's surface that the container will rest on when the container is standing. The peripheral lip 11 is the part of the base 10 which merges with the concave underside. The top portion 14 of the base 10 is a transition area between the base 10 and the container to which it is attached. Located below the top portion 14 is a base inset region 13. The base inset region 13 is typically used to maintain panel geometry through the hotfill process.

The bottom surface of the base 10 has an inner lip 16. The inner lip 16 is located closer to the longitudinal axis A than the peripheral lip 11 Inner lip 16 is located both radially and vertically closer to the center 20 of the base 10 than the peripheral lip 11. From the inner lip 16 a concave smooth surface 31 extends towards the central lip 24 which surrounds the center 20. However, the concave smooth surface 31 does not contact the central lip 24. The concave smooth surface 31 has formed therein the inverted ribs 25. When the base 10 is placed on a surface, the inverted ribs 25 are recessed with respect to the concave smooth surface 31.

The inverted ribs 25 have a smoothly inwardly curving rib perimeter 15, which forms the junction between the concave smooth surface 31 and the rib side 18. It should be understood that when the term "inwardly" is used it means the direction towards the center 20 and the central lip 24, this direction may encompass both a vertical and horizontal component. The rib side 18 extends inwardly to the bottom rib portion 22 of the inverted rib 25. The rib side 18 has a curve that enables the smooth downward curve of the inverted rib 25. The surface of the rib side 18 is triangular shaped.

Between each of the inverted ribs 25 are the rib connectors 23. The rib connectors 23 extend from the rib perimeter to the central lip 24. In the embodiment shown, the rib connectors 23 are inwardly curved. The bottom rib portion 22 curves downwardly from the apex 29, which is that part of the rib perimeter 15 that is located proximate to the inner lip 16. In the embodiment shown the apex 29 contacts the inner lip 16. The bottom rib portion 22 curves downwardly to the central lip 24.

In the base 10 shown in the figures, the bottom rib portion 22 has a radius of curvature R1, which is dependent on the base diameter. R1 may be within the range 1.000 inches to 5.000 inches. In the embodiment shown in the figures the curvature of the bottom rib portion 22 is smooth. By "smooth" it is meant that there are no abrupt changes in the curvature. The concave planar surface 31 has a radius of curvature of R2. Additionally, the radius of curvature R2, is dependent upon the base diameter and may be between the ranges of 2.000 inches to being a straight line. Furthermore, the radius of curvature R3 of the rib connector 23 may be between the ranges of 0.020 inches to 1.000 inches. The radius of curvature R1 is typically smaller than the radius of curvature R2 and greater than the radius of curvature R3.

The inverted ribs 25 are spaced equidistantly around the inner lip 16. Because the inner lip 16 is circular, the apexes 29 of the inverted ribs 25 are located every 60° along the circumference of the circle formed by the inner lip 16. The rib connectors 23 are each located equidistantly from two adjacent apexes 29 and are located equidistantly from each other. In FIGS. 2-7 the rib connectors 23 are located 60° from each other. Each of the rib connectors 23 are located 30° away from each of the adjacent apexes 29 when taken along the circumference of the circle formed by the inner lip 16. The rib connectors 23 contact the central lip 24. Additionally, the bottom rib portion 22 contacts the central lip 24.

An angle $\alpha$ is formed between the rib perimeters 15 with the vertex located at the rib connector 23. The angle $\alpha$ is less than 90°. The distance between the two rib sides 18 at the point closest to the rib perimeter 15 of the inverted rib 25 is D2. The ranges of D2 may be between 0.100 inches to 0.200 inches. It should be understood that the dimensions are dependent upon the diameter of the base 10. The base 10 would also be useable with high R1 values as well as wider or narrower D2 values. The distance D2 between the two sides 18 enables the inverted rib 25 to provide additional structure and support to the base 10. The distance D1 is the distance between the two sides of a rib perimeter 15. The distance D1 decreases as the rib perimeter 15 approaches the apex 29 of the inverted rib 25.

Figure 3:
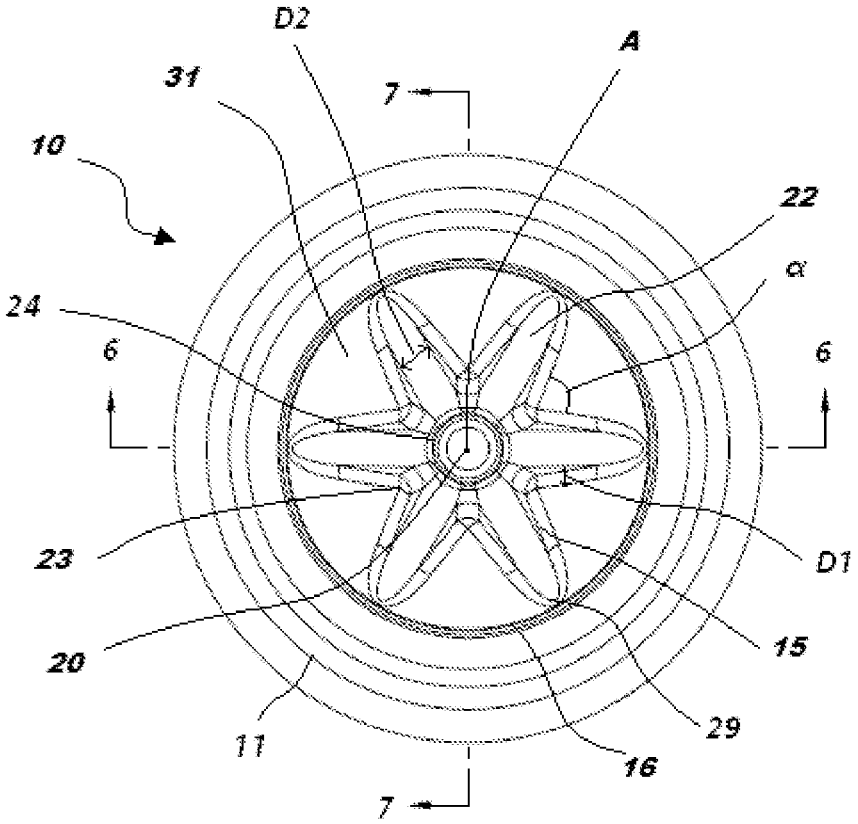
FIG. 3 is a bottom up plan view of the container base shown in FIG. 2.
Figure 4:
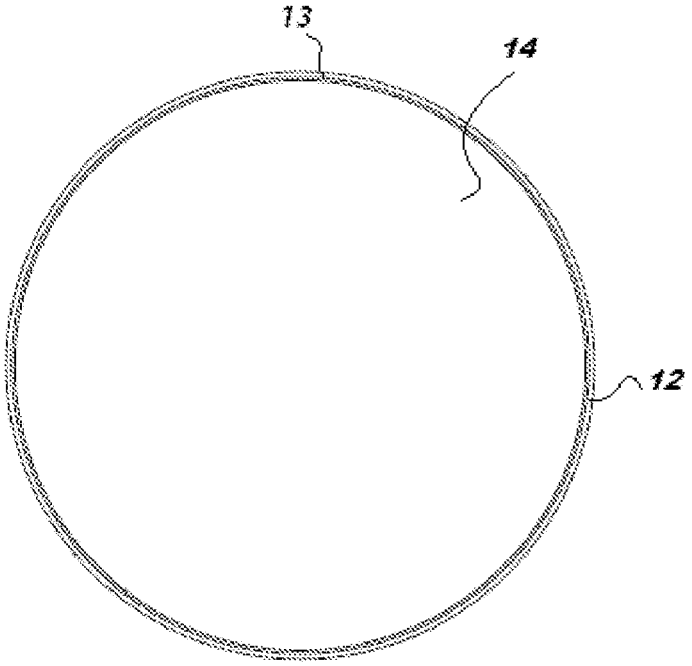
FIG. 4 is a top down view of the container base shown in FIG. 2.
Figure 5:
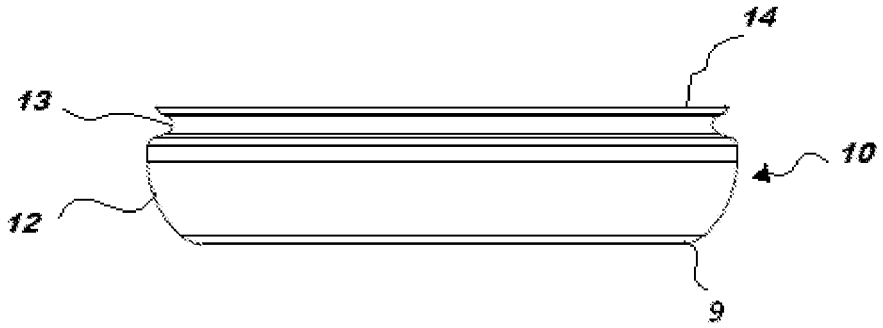
FIG. 5 is a side view of the container shown in FIG. 2.
Figure 6:
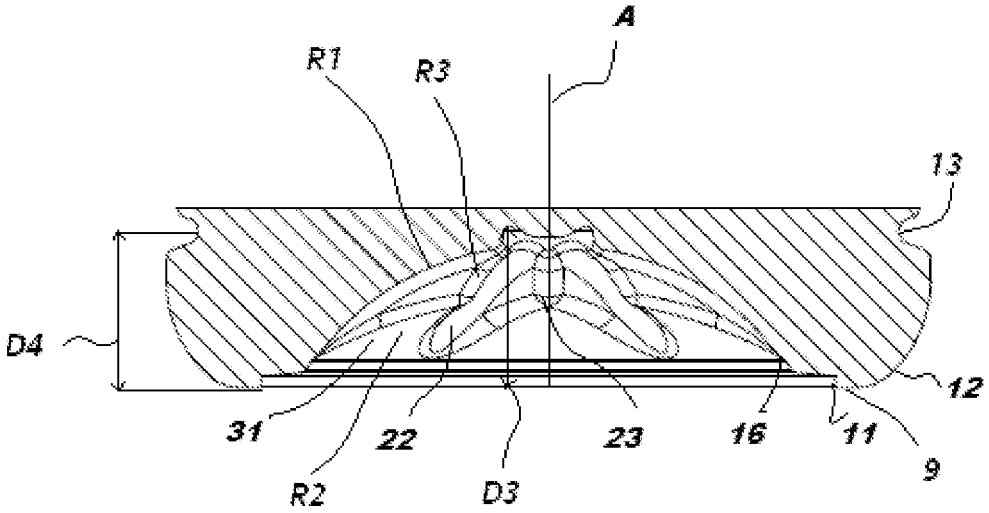
FIG. 6 is a cross-sectional view of the container shown in FIG. 3 taken along the line 6-6.

Now referring to FIG. 6, wherein a cross-sectional view of the container shown in FIG. 3 is taken along the line 6-6. Distance D3 shows the distance taken from the bottom of the central lip 24 to the bottom of the base 10 that is co-planar with the standing surface 9. Distance D4 is the distance taken from the midpoint of base inset region 13 to the bottom of the base 10 that is co-planar with the standing surface 9. The distance D3 is equal to the distance D4.

Figure 7:
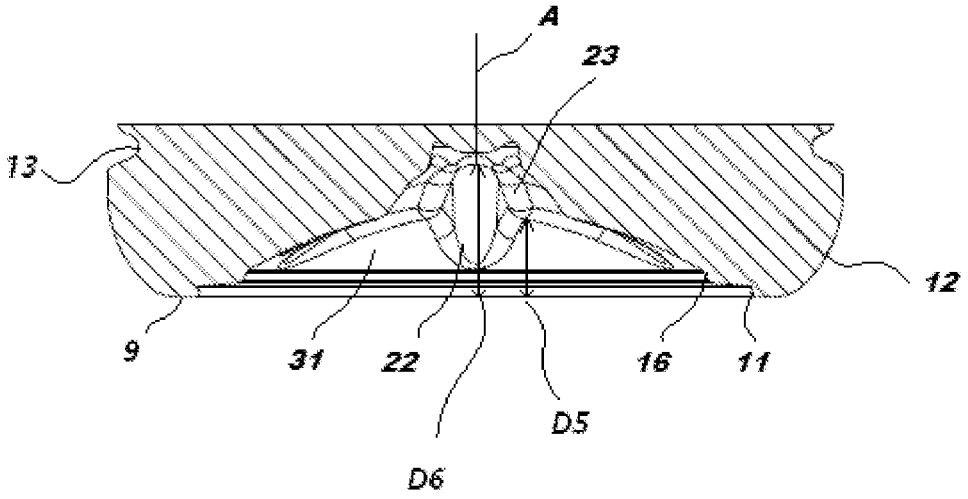
FIG. 7 is a cross-sectional view of the container shown in FIG. 3 taken along the line 7-7.

FIG. 7 is a cross-sectional view of the container shown in FIG. 3 taken along the line 7-7. Distance D5 shows the distance taken from the rib connector 23 to the bottom of the base 10 that is co-planar with the standing surface 9. Distance D6 is the distance taken from where the bottom rib portion 22 contacts the central lip 24 to the bottom of the base 10 that is co-planar with the standing surface 9. The distance D6 is greater than the distance D5.

Figure 8:
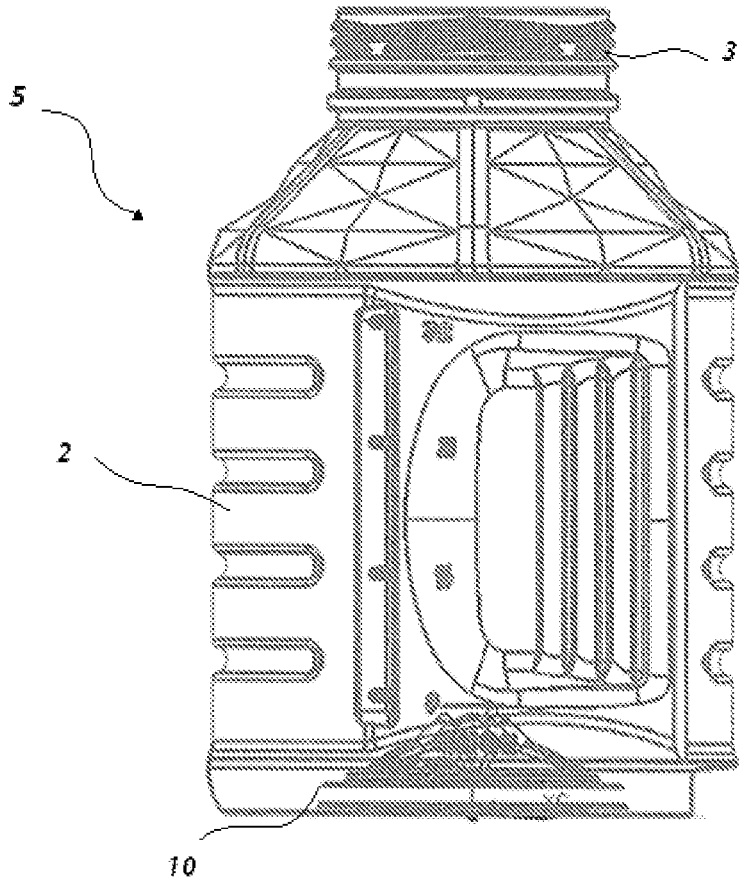
FIG. 8 is a view of the container base shown used with an exemplary jar-type container.

FIG. 8 shows an exemplary container 5 that may be employed with the base 10. In FIG. 8, container 5 is a jar-type container, having a jar-type body 2 and finish 3. As noted elsewhere, a jar-type container differs from a typical hot fill container by being filled at higher temperatures (typically 205° F. max). Additionally, jar-type containers may have larger finishes (currently up to 82 mm). Because of the larger finishes, a blow/trim process is primarily used to produce the larger finishes, therefore the finishes are thinner than injected finishes, and more susceptible to variation.

The base 10 comprises a minimal geometry base design, which can withstand the typical hot fill temperatures ranges seen by jars while maintaining or improving weight, performance and product evacuation. The base 10 provides improved processing by providing larger process windows in general than the conical base and on par with those used in traditional bases employed in hot-filling.

In the process used with base 10 as shown, the base mold was swapped out while using the same body and preform. Once this was done, the process engineer had a wider range of control with oven heats while still producing a fit for use container. One of the primary improvements was reduced base sticking and the ability to "slide" the material over the base geometry to the heel portion of the jar like container, which in turn helped to reduce base "sag" from excess material. This produced stronger heels that helped to prevent denting. These improvements may be attributed to the reduced geometry. The base 10 is able to be lighter due to its shape, while maintaining functionality.

Furthermore, product evacuation is improved with the base 10 having inverted ribs 25 arranged in an asterisk shape than the evacuation achieved with the conical bases. By product evacuation it is meant that tests were conducted where filled jars were weighed and then the product was emptied using methods that a consumer may typically use (both tapping and spooning). With the base 10 there was a 19-32% increase in evacuated product based on weight.

Additionally, the base 10 having inverted ribs 25 arranged in an asterisk shape resists crowning and sagging better than the traditional or conical style bases.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A base for a hot-fill container comprising:

an inner lip located radially from a longitudinal axis of the base;

a concave smooth surface smoothly curving from the inner lip towards the longitudinal axis;

a plurality of inverted ribs formed in the concave smooth surface and extending from the inner lip towards the longitudinal axis, wherein each inverted rib includes an outer apex located proximate to the inner lip and a bottom rib portion that smoothly curves from the outer apex towards the longitudinal axis; and rib connectors located between the plurality of inverted ribs, wherein each of the rib connectors smoothly curves towards the longitudinal axis, and further wherein each of the rib connectors has a radius of curvature smaller than a radius of curvature of the bottom rib portion.

2. The base of claim 1, wherein the bottom rib portion of each inverted rib comprises a radius of curvature that is smaller than a radius of curvature of the concave smooth surface on the base.

3. The base of claim 1, wherein each of the plurality of inverted ribs further comprises a rib perimeter, wherein two adjacent rib perimeters have an angle formed at a vertex located at one of the rib connectors, wherein the angle is less than 90°.

4. The base of claim 1, further comprising a central lip spaced from the concave smooth surface, wherein the bottom rib portion of each inverted rib is curved from the outer apex to the central lip.

5. The base of claim 1, wherein the plurality of inverted ribs form an asterisk shape in plan view.

6. The base of claim 1, wherein the base further comprises a peripheral lip located radially from the longitudinal axis of the base, wherein the inner lip is located closer to the longitudinal axis than the peripheral lip.

7. A hot-fill container comprising:

a body;

a finish; and a base comprising:

a standing surface;

an inner lip located radially from a longitudinal axis of the base, wherein the inner lip is located closer to the longitudinal axis than the standing surface;

a concave smooth surface smoothly curving from the inner lip towards the longitudinal axis;

a plurality of inverted ribs located within the concave smooth surface, wherein each inverted rib has an outer apex located proximate the inner lip and a bottom rib portion that smoothly curves from the outer apex toward the longitudinal axis; and rib connectors located between the plurality of inverted ribs, wherein each rib connector smoothly curves toward the longitudinal axis, and further wherein each rib connector has a radius of curvature smaller than a radius of curvature of the bottom rib portion.

8. The container of claim 7, wherein the base further comprises a peripheral lip located radially from the longitudinal axis of the base, wherein the inner lip is located closer to the longitudinal axis than the peripheral lip.

9. The container of claim 7, wherein the bottom rib portion of each inverted rib comprises a radius of curvature that is smaller than a radius of curvature of the concave smooth surface.

10. The container of claim 7, wherein the body is a jar-type body.

11. The container of claim 7, further comprising a central lip located radially from the longitudinal axis and spaced from the concave smooth surface, wherein the bottom rib portion of each inverted rib is curved from the outer apex to the central lip.

* * * * *